US005518438A

United States Patent [19]

Munoz et al.

[11] Patent Number: 5,518,438

[45] Date of Patent: May 21, 1996

[54] APPARATUS AND METHOD FOR GRINDING NEEDLE WORKPIECES

[75] Inventors: Marcelino P. Munoz, Waterbury; W. Scott Samsel, Bristol; Eugene P. Cybart, Jr., Seymour, all of Conn.

[73] Assignee: United States Surgical Corporation, Norwalk, Conn.

[21] Appl. No.: 133,564

[22] Filed: Oct. 8, 1993

[51] Int. Cl.[6] ..... B24B 19/16

[52] U.S. Cl. ..... 451/11; 451/182; 451/241; 451/245; 451/337; 451/339; 451/541

[58] Field of Search ..... 451/11, 177, 182, 451/241, 245, 336, 337, 339, 541, 545

[56] References Cited

U.S. PATENT DOCUMENTS

| | | | |
|---|---|---|---|
| 160,686 | 3/1875 | Kingman . | |
| 279,075 | 6/1883 | Berry . | |
| 1,175,831 | 3/1916 | Spinney | 451/337 |
| 1,486,435 | 11/1924 | Hunt . | |
| 1,532,490 | 4/1925 | Hunt . | |
| 2,109,450 | 3/1938 | Schlayer et al. | 451/337 |
| 2,353,683 | 7/1944 | Martines . | |
| 2,452,205 | 10/1948 | Newton . | |
| 2,838,883 | 6/1958 | Hall . | |
| 4,173,100 | 11/1979 | MacBroom, Jr. . | |
| 4,216,628 | 8/1980 | Wada . | |
| 5,155,943 | 10/1992 | Matsutani et al. . | |

FOREIGN PATENT DOCUMENTS

| | | |
|---|---|---|
| 0397955 | 5/1989 | European Pat. Off. . |
| 3141276 | 10/1981 | Germany . |

*Primary Examiner*—Maurina T. Rachuba

[57] ABSTRACT

An apparatus for grinding tapered points on needles is disclosed. The apparatus has a frame and a transport associated with the frame for transporting a plurality of needles. The transport has a predetermined curvature and a feeder is mounted adjacent the frame for feeding needles to the transport. A grinding wheel is disposed adjacent the transport and has a major diameter at a first end and a minor diameter at a second end, the major diameter being greater than the minor diameter and connected by a curved grinding surface the diameter of which increases progressively therebetween. The curvature of the grinding wheel in a first third portion between the major and minor diameters is of greater mean curvature than the mean curvature of the corresponding opposed portion of the transport. A second third portion of the grinding wheel is of greater mean curvature than the mean curvature of the corresponding opposed portion of the transport. The mean curvature difference therebetween is less than the difference of the first portion with respect to the first portion's corresponding opposed portion of the transport, and a third portion being of lesser mean curvature than the corresponding opposed portion of the transport such that a surface portion of a needle which contacts the grinding surface varies relative to the position of the needle with respect to the grinding surface. A method of grinding needles is also disclosed.

19 Claims, 13 Drawing Sheets

FIG.2
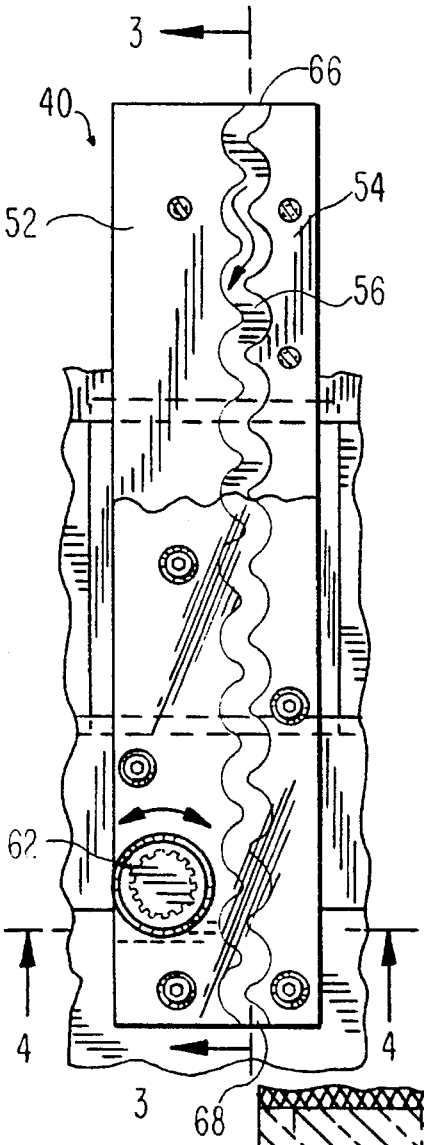
FIG.3
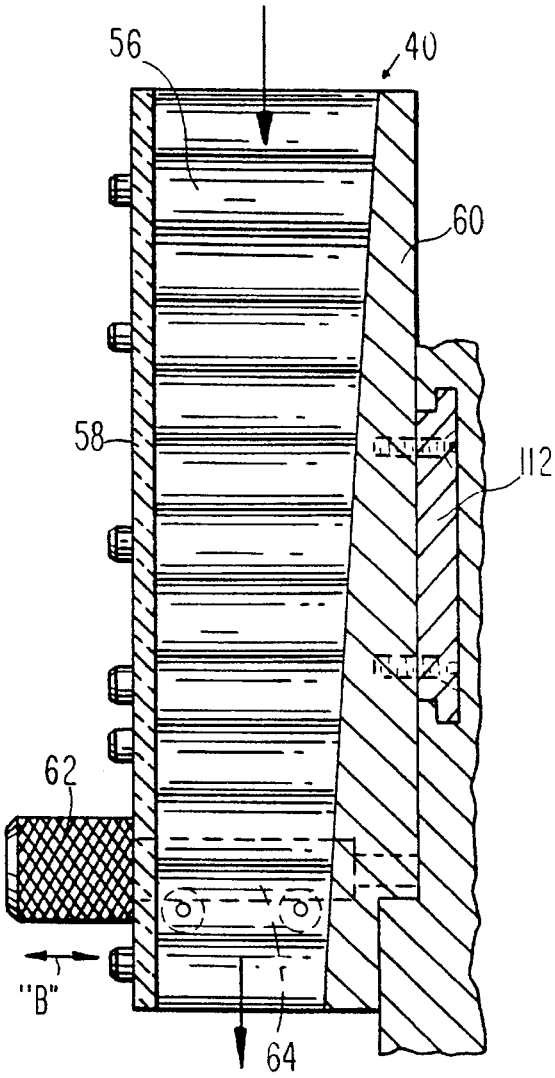
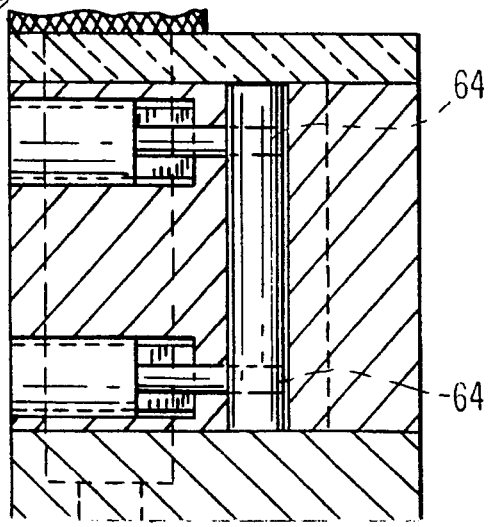
FIG.4

FIG.8
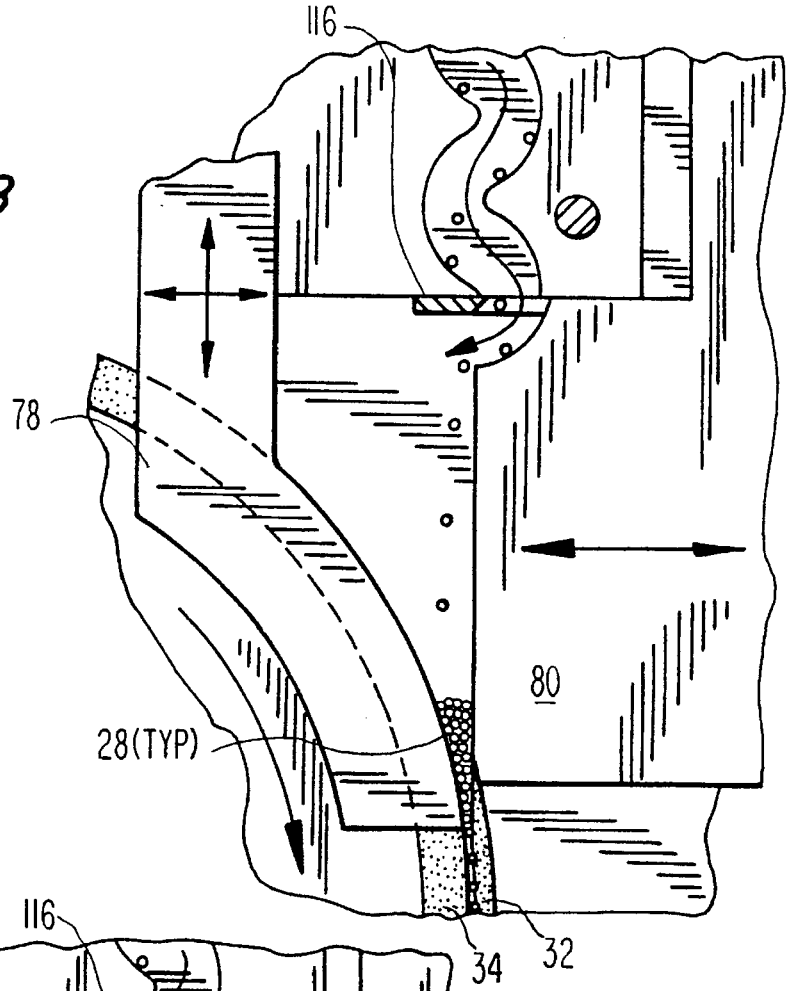
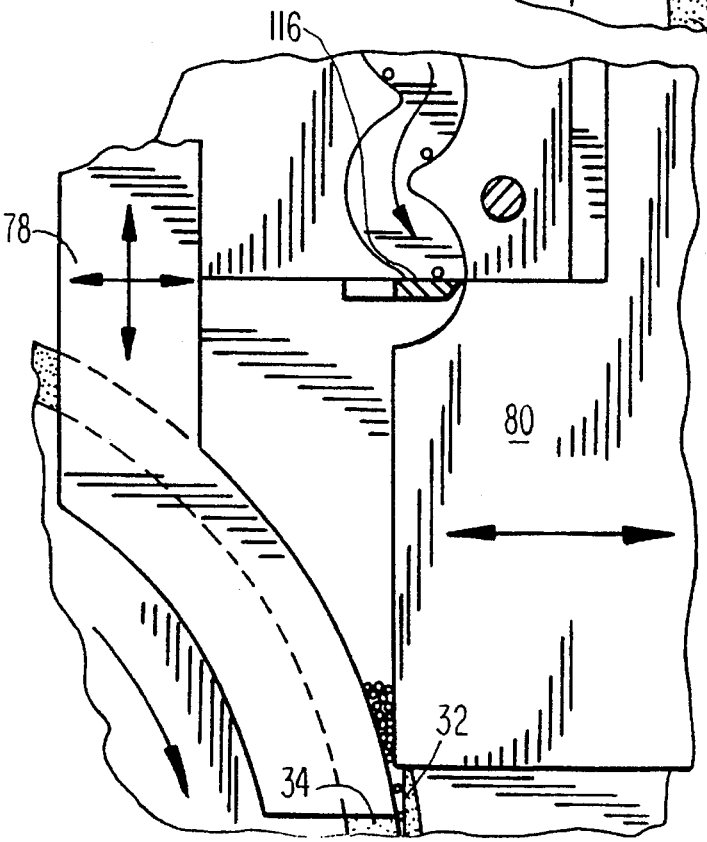
FIG.9

FIG.12
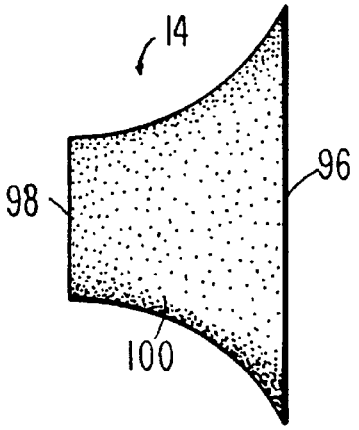
FIG.13
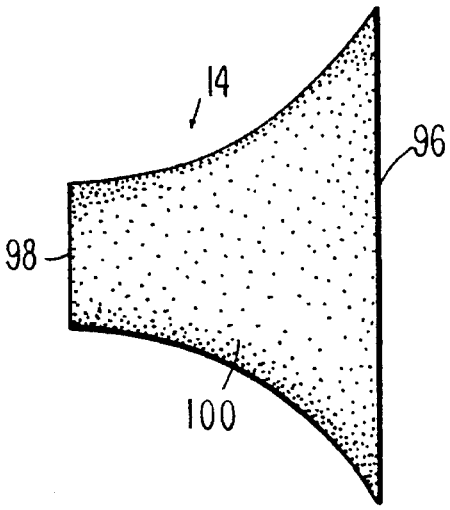
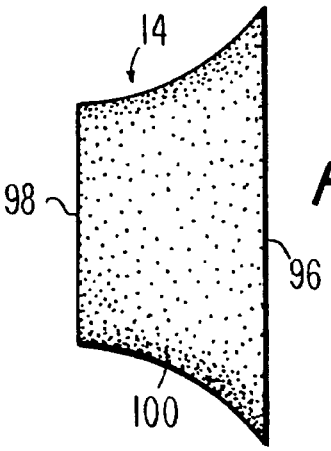
FIG.14
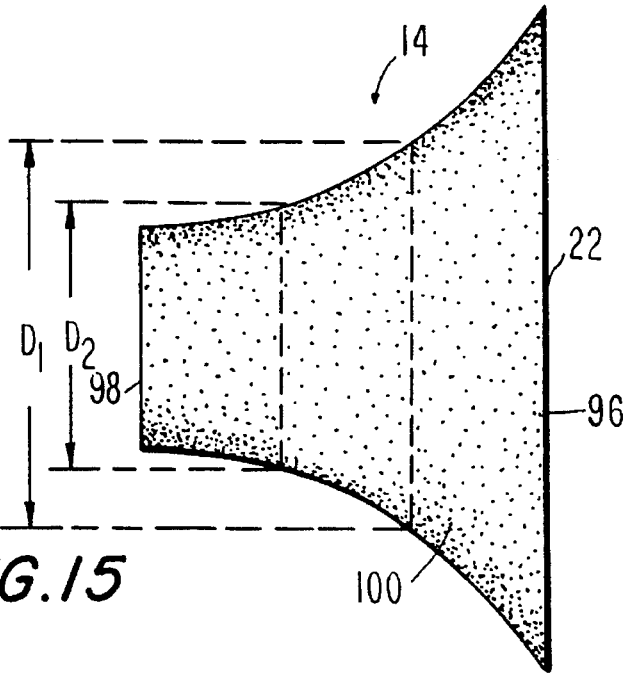
FIG.15

APPARATUS AND METHOD FOR GRINDING NEEDLE WORKPIECES

BACKGROUND OF THE INVENTION

1. Field of the Invention

This invention relates to apparatus and method for grinding tapers on elongated stock and more particularly for grinding points on needle stock.

2. Description of the Related Art

The production of quality needles from raw stock involves many different processes and machinery. These varying processes and machinery become more critical in the preparation of surgical needles where the environment of intended use is in humans or animals. Some of the processes involved in the production of surgical grade needles include, inter alia: straightening spooled wire stock; cutting needle blanks from raw stock; providing a bore for receiving suture thread at one end of the blank; tapering or grinding points at the other end of the blank, flat pressing a portion of the needle barrel to facilitate easier grasping by surgical instrumentation; and, where curved needles are desired, curving the needle. During each of these several steps, extreme care must be taken to ensure that only the intended working of the needle is performed and that the other parts of the needle remain undisturbed.

Machines for grinding points of needles are known. Such machines include the Type NS 6, 8, 11 and 15 automatic point grinding machines available from SCHUMAG Machinery, Inc. of Norwood, N.J. Those machines utilize, for example, a transport wheel and saddle arrangement to present wire shafts to a grinding wheel so as to grind points on the ends of the shafts. A notched wheel is provided for spacing apart the wire shafts and presenting them to the grinding wheel surface. Different sized notched wheels are required for different wire shaft diameters. Thus, in order to change diameter shafts being ground, the appropriate notched wheel must first be installed before grinding of the differing diameter shaft needle blanks can take place. This requires shutting down production and fitting the machine with the appropriate notched wheel each time stock having a diameter not appropriate for the current wheel is to be ground.

Additionally, to operate efficiently, these machines require that the minimum wire shaft length must be longer than many of the surgical needles presently in use, thus necessitating additional finishing steps to refine the dimensions of the needles. Therefore, in order to form a finished needle, for example, having a length of 0.875 inches, stock of at least 1¾ inches would have to first be ground and then be clipped to the desired length. By performing the grinding first and then having to clip the needle shaft to the desired length, chances are increased that the needle point will become damaged during handling and clipping. Moreover, clipping the end of needle stock necessitates additional processing and quality control steps. Specifically, any burrs or other irregularities created from the clipping must be removed and samples inspected to ensure the quality of the work.

Machines for grinding point of needles are known to utilize workpiece feed hoppers and workpiece off-load hoppers. Workpiece feed hoppers provide storage means for storing the workpieces and outlet means for discharging the workpieces to a feed point on the point grinding machine. The workpiece off-load hoppers, similarly, have inlet means for receiving workpieces from an off-load point of the point grinding machine and storage means for storing the workpieces. A problem encountered with both the workpiece feed hoppers and with the workpiece off-load hoppers is the jamming of workpieces at the respective feed and off-load points. Jamming typically occurs when two or more workpieces become wedged against each other at the feed and off-load points. In response to the occurrence of jamming, agitating means has been employed to vibrate the workpieces to prevent as well to correct the jamming of workpieces. Although the use of agitating means provides an improved flow of workpieces to and from the point-grinding machine, the geometry of the hoppers remains such that a plurality of workpieces can jam at the feed point and at the off-load point resulting in the shutting down of production to locate the jam and remove the blockage.

With respect to the storage aspect of the workpiece feed and off-load hoppers, known hoppers are mounted to the point grinding machine in a manner which does not facilitate an expedient replacement of hoppers. Typically, workpiece feed hoppers are supplied or filled with a set amount or batch of workpieces to be machined. When the workpiece feed hopper is empty, production ceases until a refilling operation occurs. Similarly, when the workpiece off-load hopper is full, production must be halted until the hopper can be unloaded. The loading and unloading of workpiece feed and off-load hoppers is time consuming and accordingly a significant cost. There is a need to provide workpiece hoppers which minimize the time required to load and unload workpieces from said hoppers.

Down time of known point grinding machines is also encountered when a change in the size of workpieces is desired. The feeding means of the point grinding machine is, like the workpiece hoppers, affixed in a permanent manner to the point grinding machine. The feeder means, not efficiently mounted to facilitate a quick replacement thereof, must be adjusted to properly interface with each size of workpiece to pass therethrough. Adjustment means are typically provided, but again, require production to cease for a significant time while the adjustment takes place. A need therefore exists for providing feeder means which minimize the time required to set up for a different sized workpiece.

Although, as mentioned above, adjustment means are typically provided on known point grinding machines, the adjustment means do not generally provide multiple axis adjustment capability for varying the spacial relationship of the grinding wheel and the transport wheel. As a result, the adjustment means do not adequately compensate for wear of the grinding wheel. A need therefore exists for providing improved adjustment means which provide maximum compensation for wear of the grinding wheel by providing multiple axis adjustment capability. Secondly, as known grinding wheels experience wear which cannot be compensated for by adjustment means, the wheels are redressed in order to maintain the optimum grinding surface configuration. Redressing methods, however, are dangerous and time consuming. Redressing is required because the wheel does not wear equally along the wheel surface, and therefore the areas of greater wear need to be redressed in order to recapture the optimum surface configuration. If the configuration of the wheel were such that the wheel would wear equally along its surface thereby maintaining on optimum surface configuration while experiencing only a reduction in diameter, then adjustment means would be capable of compensating for the wear of the wheel by simply restoring the desired spacial relationship between the grinding wheel and the transport wheel. A need therefore exists for a grinding wheel which has a fixed optimum shape which is configured to wear evenly, minimizing redressing of the wheel, and facilitating wear compensation through adjustment means.

Finally, grinding wheels employed by these known devices typically have a first edge, and a second edge, with respective diameters of the first edge and second edge of substantially equal value. An intermediate portion of the grinding wheel disposed between the first edge and second edge, generally has a smaller diameter than that of the first edge and second edge. Typically, at a point on the intermediate portion equidistant to the first edge and second edge, the diameter of the grinding wheel is less than that at any other point between the first and second edges. As workpieces are exposed to grinding wheel with the above described conventional design, a surface of the workpiece is first put into contact with the grinding wheel at the first edge. As the workpiece is directed towards the midpoint of the grinding wheel, smaller surfaces of the workpiece are exposed to the grinding wheel thereby forming a taper on the workpiece. When the workpiece reaches the midpoint of the grinding wheel, a point has typically been formed on the workpiece. As the workpiece is further directed from the midpoint to the second edge of the grinding wheel, the grinding wheel does not provide grinding on an untreated portion of the workpiece, but is exposed to tapered and point portions of the workpiece. The second half of these known grinding wheels, the second half being the portion of the grinding wheel from the midpoint to the second edge, provides redundant exposure of the grinding wheel to the workpiece. A need therefore exists for a grinding wheel which is capable of grinding tapers and points on elongated stock while minimizing the time and cost associated with redundant exposure of the grinding wheel to the workpiece.

When it is necessary to grind different sized workpieces, or to replace a worn grinding wheel, known grinding machines generally require a significant amount of time to first replace the grinding wheel, and then adjust other components of the grinding machine to accommodate the new wheel. A need therefore exists for a grinding apparatus having grinding wheel which are capable of being replaced with minimum down time and cost associated with the replacement.

When performing the grinding operation using known grinding wheels, known methods attempt to have the same grinding wheel perform all of the grinding on the needle stock, including critical point forming. Typically, it is very difficult to achieve desired point geometry with the same grinding wheel which has an abrasiveness capable of removing large amounts of needle stock material. Accordingly, when using one grinding wheel to perform "roughing" and "polishing," desired needle stock point geometry is often not achieved. A need therefore exists for a method of grinding needle stock tapers and points which achieves desired needle point geometry. The present invention is directed toward apparatus and method for grinding high quality surgical needles while avoiding the disadvantages of known devices.

SUMMARY OF THE INVENTION

An apparatus is disclosed for grinding elongated needle workpieces, which comprises frame means, needle workpiece transport means associated with the frame means for transporting a plurality of elongated needle workpieces therealong. The needle workpiece transport means has a predetermined curved transport surface. A needle workpiece feeder means is adjacent to the frame means and adapted for feeding needle workpieces to the needle workpiece transport means. Needle workpiece supporting means is disposed adjacent said needle workpiece feeder means for supporting the needle workpieces in contact with the needle workpiece transport means. A grinding wheel is disposed adjacent the needle workpiece transport means to engage the needle workpieces while supported by the needle workpiece supporting means, the grinding wheel having a first end of a major diameter and a second end of a minor diameter, the major diameter being greater than said minor diameter. The diameters are connected by a curved grinding surface the diameter of which increases progressively. The needle workpiece transport means has a generally convex outer working surface and the grinding wheel has a generally concave outer working surface positioned opposite the surface of the transport means.

Further, in a preferred embodiment, the radius of curvature of the grinding surface of the grinding wheel in a first one third portion adjacent the first end is of greater mean curvature than the mean curvature of the corresponding opposed portion of the needle workpiece transport means. A second one third portion of the grinding wheel is of greater mean curvature than the mean curvature of the corresponding opposed portion of the needle workpiece transport means, the mean curvature difference being less than the difference between the mean curvature of the first one third portion of the grinding wheel and the first corresponding opposed one third portion of the needle workpiece tranport means. A third one third portion, adjacent the second end, is of lesser mean curvature than the corresponding opposed portion of the needle workpiece transport means such that a surface portion of a workpiece which progressively contacts the grinding surface between the first and second ends varies relative to the position of the workpiece with respect to the grinding surface. In one embodiment the variation is such that the mean curvature difference between the third and second one third portions is less than the mean curvature difference between the second and first one third portions.

In a preferred embodiment, feeder storage means is disposed adjacent the needle workpiece transport means and the needle workpiece supporting means, for storing the workpieces and supplying the workpieces to a feed point located between the needle workpiece transport means and the needle workpiece supporting means. The workpieces are individually positioned between the workpiece transport means and said workpiece supporting means.

In another embodiment needle workpiece reception means is disposed adjacent the grinding wheel for reception of workpieces from an off-load point located between the grinding means and the workpiece reception means, such that the workpieces are individually received therein. In addition, off-load needle workpiece storage means is disposed adjacent the needle workpiece reception means for reception of the workpieces therefrom.

In another preferred embodiment, the feeder storage means is detachable, and disposed adjacent the needle workpiece feeder means for storing the workpieces and supplying the workpieces to the needle workpiece feeder means. The needle workpiece reception means is disposed adjacent the grinding wheel for reception of the workpieces from an off-load point located between the grinding means and the workpiece reception means, such that the workpieces are individually received therein. Further, the off-load workpiece storage means is disposed adjacent the off-load means for reception of workpieces from the off-load means.

In yet another preferred embodiment, the detachable feeder storage means comprises a cartridge having an inlet means for reception of the workpieces, storage means for storing the workpieces and outlet means for discharging the workpieces to the needle workpiece feeder means in a cascading fashion. In addition, the off-load workpiece storage means comprises a cartridge having inlet means for individual reception of the workpieces from the workpiece reception means and storage means for reception of said workpieces in a cascading fashion wherein the workpieces are stored. Further, the apparatus includes a means for adjusting the position of the grinding means relative to the needle workpiece supporting means and the transport means.

The needle workpiece feeder means preferably includes adjusting means having at least one adjustment micrometer operatively connected to the needle workpiece feeder means. In addition, the needle workpiece feeder means comprises a feed well, the workpiece feeder means further comprising left side adjustment means, and right side adjustment means. The feed well has an inlet for reception of workpieces from the feeder storage means, and a channel portion disposed between the inlet and the feed point configured to allow the workpieces from the inlet to pass therethrough to the feed point. The left side adjustment means and said right side adjustment means are configured to vary the size and position of the feed point.

Off-load needle reception means is provided adjacent to the grinding wheel and adapted for reception of ground needle workpieces, the off-load needle reception means having an off-load well, the off-load well having an inlet for reception of workpieces from the off-load point, an outlet, and a channel portion disposed between the inlet and the outlet configured to allow the workpieces from the inlet to pass therethrough and exit via the outlet to the off-load storage means.

The grinding wheel is preferably comprised of material selected from the group consisting of steel or aluminum, and at least a portion of the grinding surface of the grinding wheel is formed of an abrasive grinding material. In another preferred embodiment, the material is selected from the group consisting of cubic boron nitrite, diamond, silicon carbide and aluminum oxide. Preferably, the abrasive grinding material is electroplated. When polishing of the needle workpieces is desired, a grinding wheel with lesser course material, but same shape is used. Preferably, when polishing, the grinding wheel is comprised of resin bonded, or rubber bonding material.

A method is disclosed of grinding and polishing needle workpieces to form a pointed needle working tip comprising the steps of, taking at least one needle workpiece having an initial diameter, pregrinding the at least one needle workpiece to taper one end portion to a blunt end such that the resultant diameter of said blunt end is between about 20 and about 40 percent of the initial diameter of the needle workpiece, and polishing said tapered portion of the at least one needle workpiece to form a pointed tip.

BRIEF DESCRIPTION OF THE DRAWINGS

Preferred embodiments of the invention are described hereinbelow with reference to the drawings wherein:

FIG. 2 is frontal view of a cascade-type cartridge according to an embodiment of the grinding machine of the present invention;

FIG. 3 is a cross-sectional view taken along line 3—3 of FIG. 2 illustrating the channel of the cascade-type cartridge;

FIG. 4 is cross-sectional view taken along line 4—4 of FIG. 2 illustrating the lock pins of the cascade-type cartridge;

FIG. 8 is a partial view illustrating the shutter arm of the grinding machine of the present invention;

FIG. 9 is a view similar to FIG. 8 illustrating the shutter arm of the feed well in a closed position;

FIG. 12 is a frontal view of a grinding wheel of a preferred embodiment of the present invention;

FIG. 13 is a frontal view of a grinding wheel of a preferred embodiment of the present invention;

FIG. 14 is a frontal view of a grinding wheel of a preferred embodiment of the present invention;

FIG. 15 is a frontal view of a grinding wheel of a preferred embodiment of the present invention;

DETAILED DESCRIPTION OF THE PREFERRED EMBODIMENTS

Figure 1:
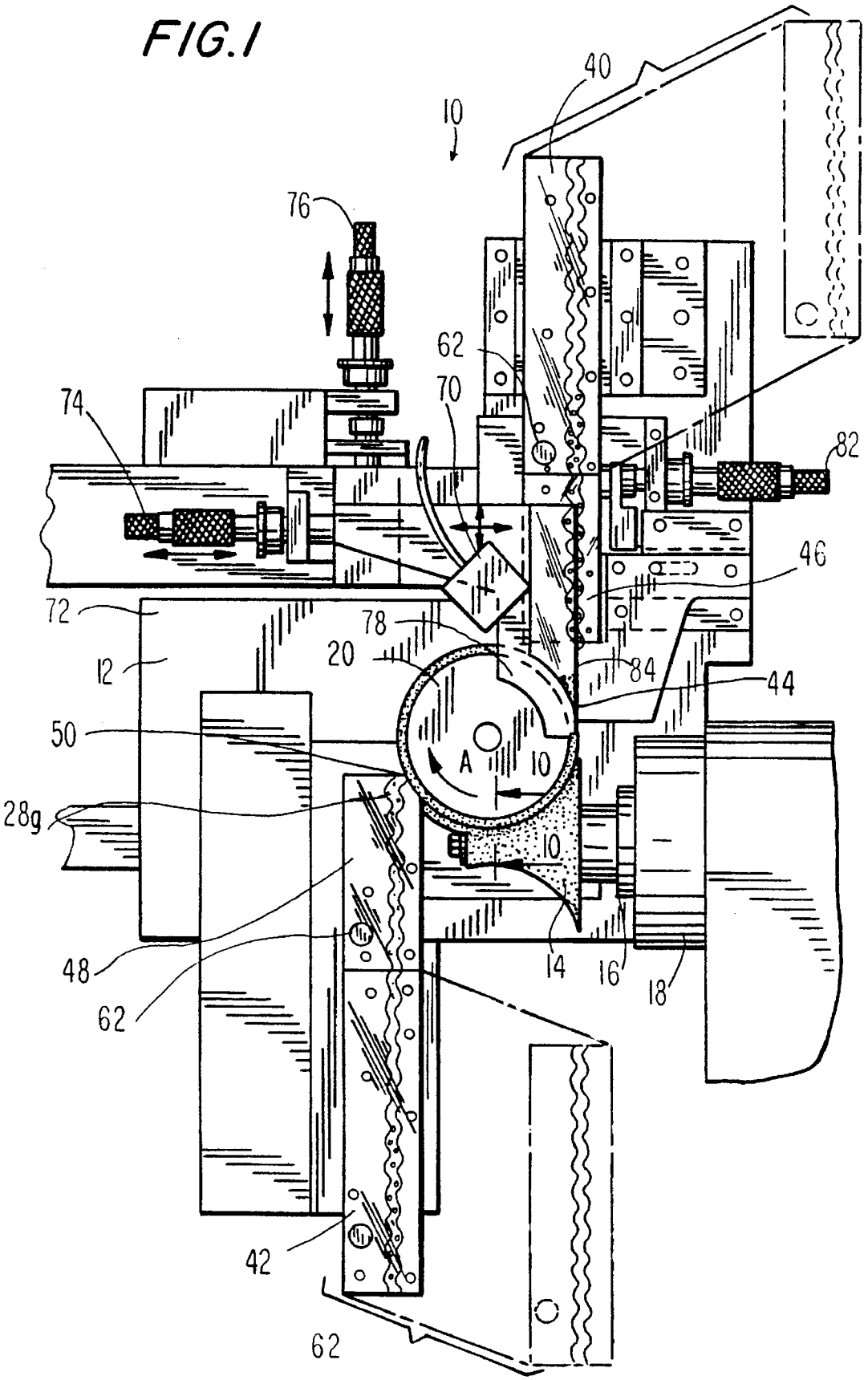
FIG. 1 is a frontal view of the grinding machine of the present invention.

In the drawings like reference numerals identify similar or identical elements throughout the several views. In addition, while the following description is directed toward an apparatus and method for grinding points on surgical needles, it will be appreciated to those having ordinary skill in the art that the present invention may be used to grind other objects as well. For example, the present invention may be used to grind points on many different types of elongated workpiece stock.

In the description which follows, the curved character of such surfaces as the surface of a grinding wheel or needle workpiece transport wheel is defined in terms of its curvature, or mean curvature. In other words, as the curvature of a surface increases, the corresponding radius of that surface decreases. Furthermore, since the curved surface of the grinding wheel and the transport wheel contemplated herein generally comprise relatively complex constructions of various continuous curvatures of different radii, the curvature of such surfaces is referred to herein as the "mean curvature," i.e., a mathematical average of the various radii of continuous curved portions which join to constitute a larger curved surface.

Figure 6:
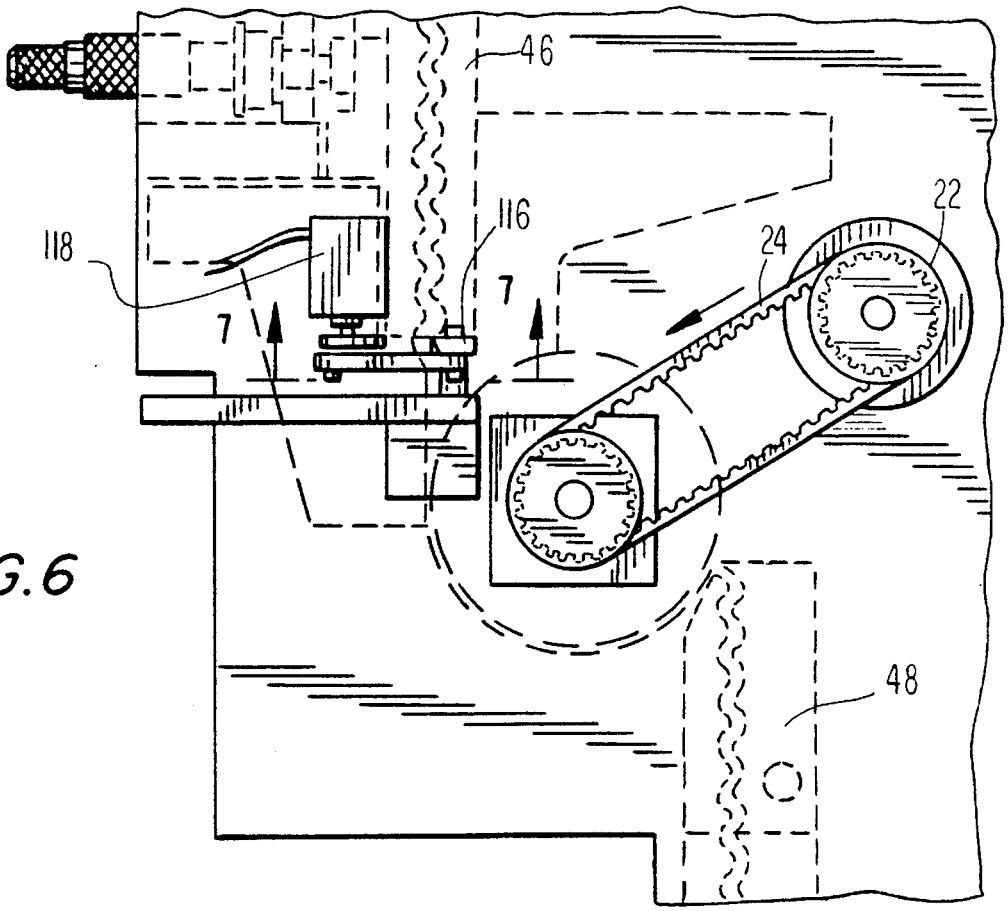
FIG. 6 is a partial rear view of the grinding machine of the present invention illustrating the transport wheel motor.

Referring initially to FIG. 1, apparatus 10 for grinding points on needle stock is illustrated. The needle stock contemplated herein includes all known needle stock and sizes thereof including micro-needle stock. The apparatus generally includes frame 12; grinding wheel 14, mounted on mandrel 16 and driven by drive motor 18; and transport wheel 20, driven by motor 22 via drive belt 24 (FIG. 6). Unless otherwise noted, components of apparatus 10 are generally fabricated of aluminum, tool steel or rubber of optimum durometer and thickness. Grinding wheel 14 is preferably of the electroplated type, having a core made of aluminum or other suitable material, plated with an abrasive material such as Borazon. Alternatively, other known abrasive materials and bonding methods therefore, may also be substituted for Borazon, for example, diamond, aluminum oxide ($Al_2O_3$) or silicon carbide (SiC).

Figure 10:
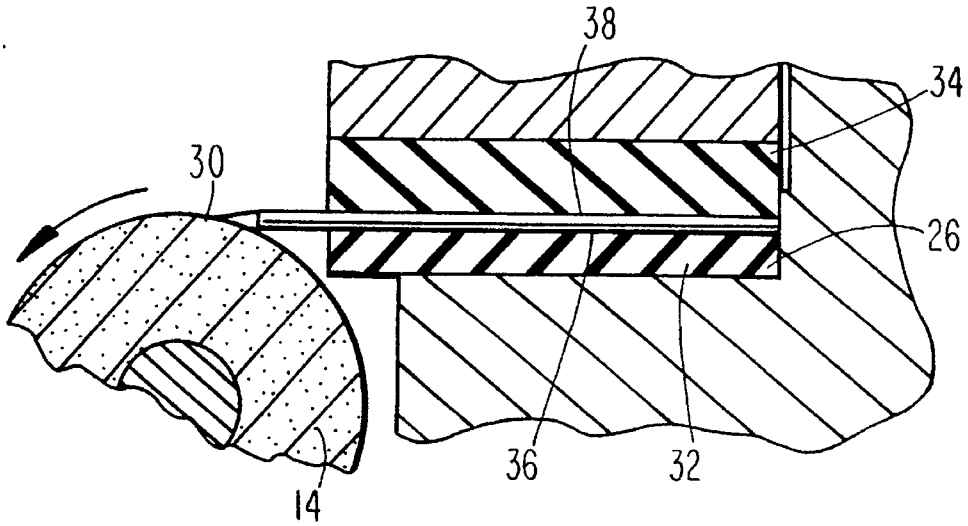
FIG. 10 is a partial side view of a workpiece being ground by a grinding wheel according to a preferred embodiment of the present invention.
Figure 11:
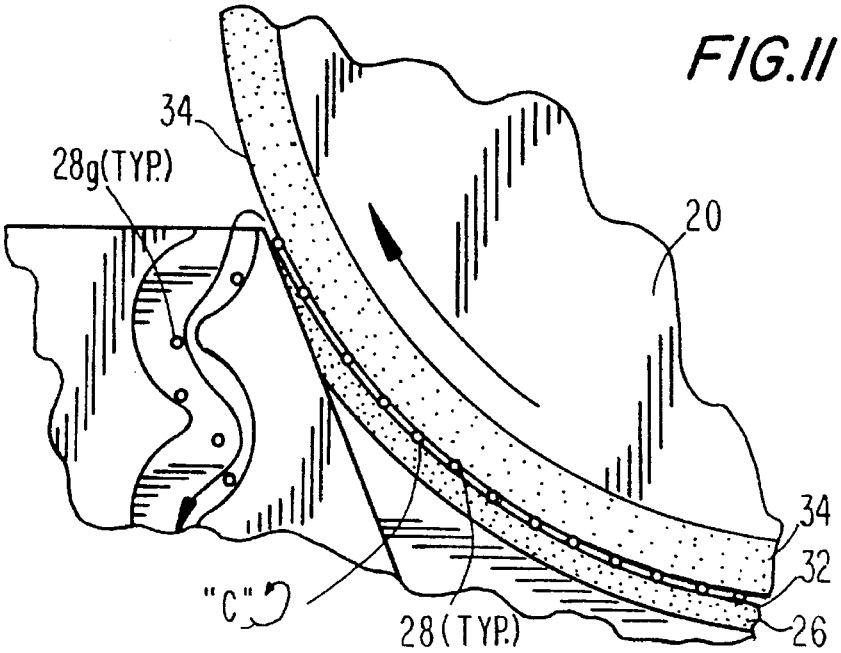
FIG. 11 is a partial front view of the off-load point of the grinding machine of the present invention.
Figure 12A:
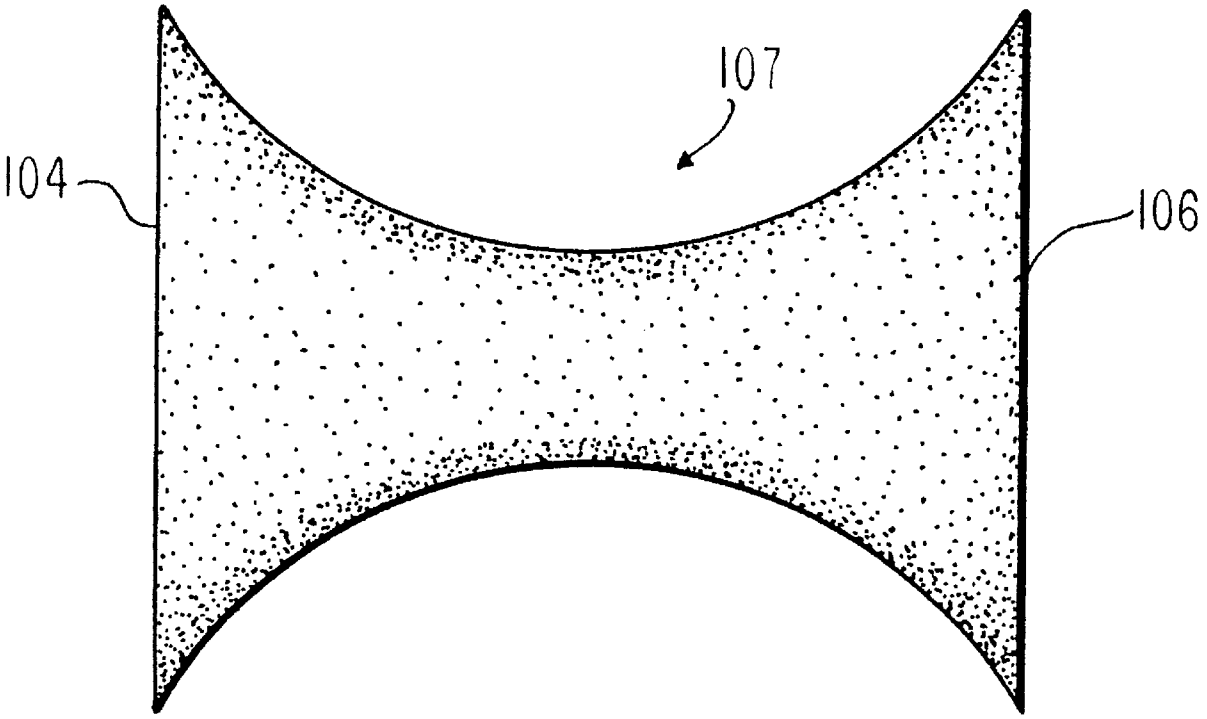
FIG. 12*a* is a frontal view of a known grinding wheel.

Referring to FIGS. 10–11, saddle 26 is shaped to conform to the curvature of transport wheel 20 and is provided such that needle stock 28 are supported in contact with transport wheel 20 as they traverse grinding surface 30 of grinding wheel 14. Rubber layers 32 and 34 are provided between saddle 26 and transport wheel 20, respectively, to provide friction surfaces 36 and 38 which supply traction for needle stock 28 traveling between the two friction surfaces.

Referring once again to FIG. 1, pre-ground needle stock workpiece storage is provided by delivery feed hopper 40 and ground workpiece storage is provided by off-load hopper 42. Hoppers 40 and 42 are provided to respectively deliver and receive needle stock workpieces to feed point 44 via feed well 46 and off-load well 48 via off-load point 50 located between saddle 26 and transport wheel 20, before and after grinding takes place. The grinding of needle stock 28 is accomplished as needle stock 28 are directed by transport wheel 20 into contact with grinding wheel 14, such as described in copending U.S. patent application Ser. No. 07/959,054, filed Oct. 9, 1992, incorporated herein by reference.

In a preferred embodiment as illustrated in FIGS. 2–4, feed and off-load hoppers 40 and 42 are in the form of cascade-type detachable and interchangeable cartridges, hereinafter referred to as "feed cartridge 40" and "off-load cartridge 42" respectively. Cascade-type cartridges permit passage of the workpieces downwardly through a generally serpentine channel in somewhat cascading fashion.

Referring again to FIGS. 2–4, feed cartridge 40 includes left half section 52 and right half section 54 defining channel 56 therebetween. Left half section 52 and right half section 54 are affixed to front plate 58 and rear plate 60. Stop knob 62 is connected to stop pins 64 for selective movement of stop pins 64 into and out of channel 56 for the purpose of blocking and unblocking the flow of needle stock workpieces into and out of channel 56.

Referring again to FIGS. 2–4, feed cartridge 40 includes inlet 66 for reception of the needle stock workpieces 28, and an outlet 68, with channel 56 disposed therebetween and configured to permit the workpieces to pass individually from inlet 66 therethrough to outlet 68. Channel 56 is best shown in this preferred embodiment forming a generally sinusoidal or serpentine shape having a plurality of alternately reversing curves in order to promote uniform passage of the needle stock workpieces without interference or jamming with each other. It should be readily understood by those skilled in the art that channel 56 could be provided in many alternative shapes and configurations.

A workpiece agitating device 70 is preferably provided on apparatus 10 to introduce vibrations within feed well 46. For example, in the preferred embodiment of the present invention as shown in FIG. 1, vibrator 70 is attached to frame 12 in close adjacent relation to feed well 46 for the purpose of directly introducing vibrations within feed well 46. Other devices may be used, for example, pneumatically, hydraulically, or electrically operated devices can be mounted on apparatus 10 to vibrate needle stock 28 such that the needle stock is prevented from jamming at feed point 44. When grinding micro-needle stock, i.e., needle stock in the order of about 0.4 millimeters or less in diameter, on apparatus 10, the size of the needle stock is sufficiently small as to present particular handling difficulties. Accordingly, a micro-needle pusher assembly including pushing means is preferably provided to assist gravity and to selectively position the micro-needles at feed point 44 shown in FIG. 1.

Figure 19:
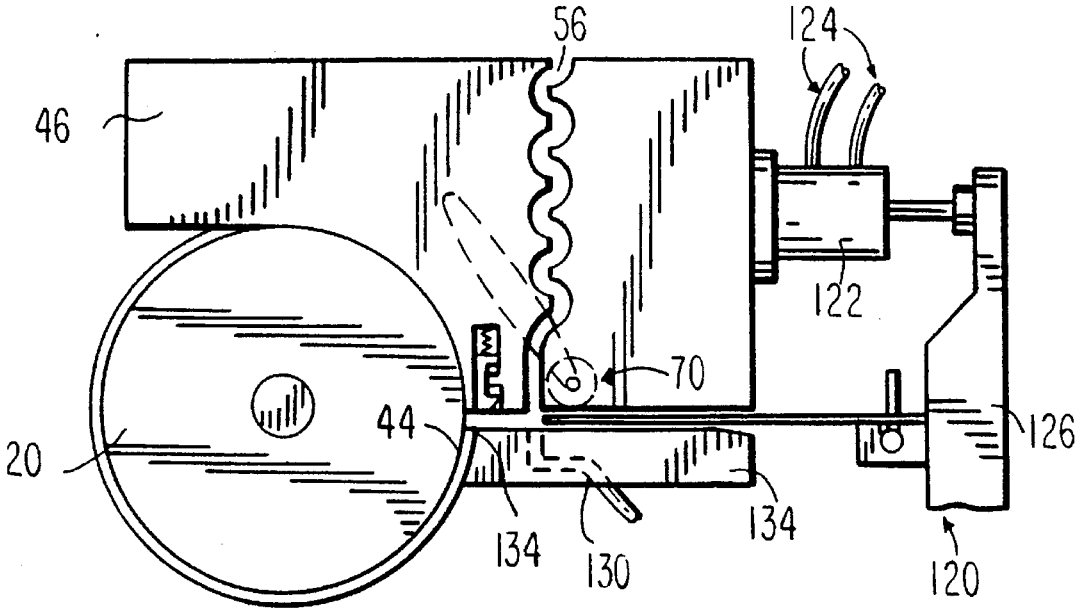
FIG. 19 is a frontal view greatly enlarged, of a needle supporting end pusher assembly of the present invention for supporting and directing micro-needle stock to the feed point of the grinding wheel of the apparatus.
Figure 20:
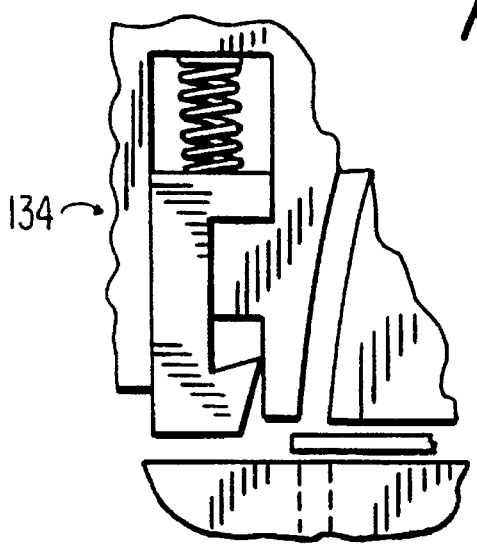
FIG. 20 is an enlarged frontal view of the stripper assembly of the present invention for selective passage and blockage of micro-needle stock to the feed point.
Figure 21:
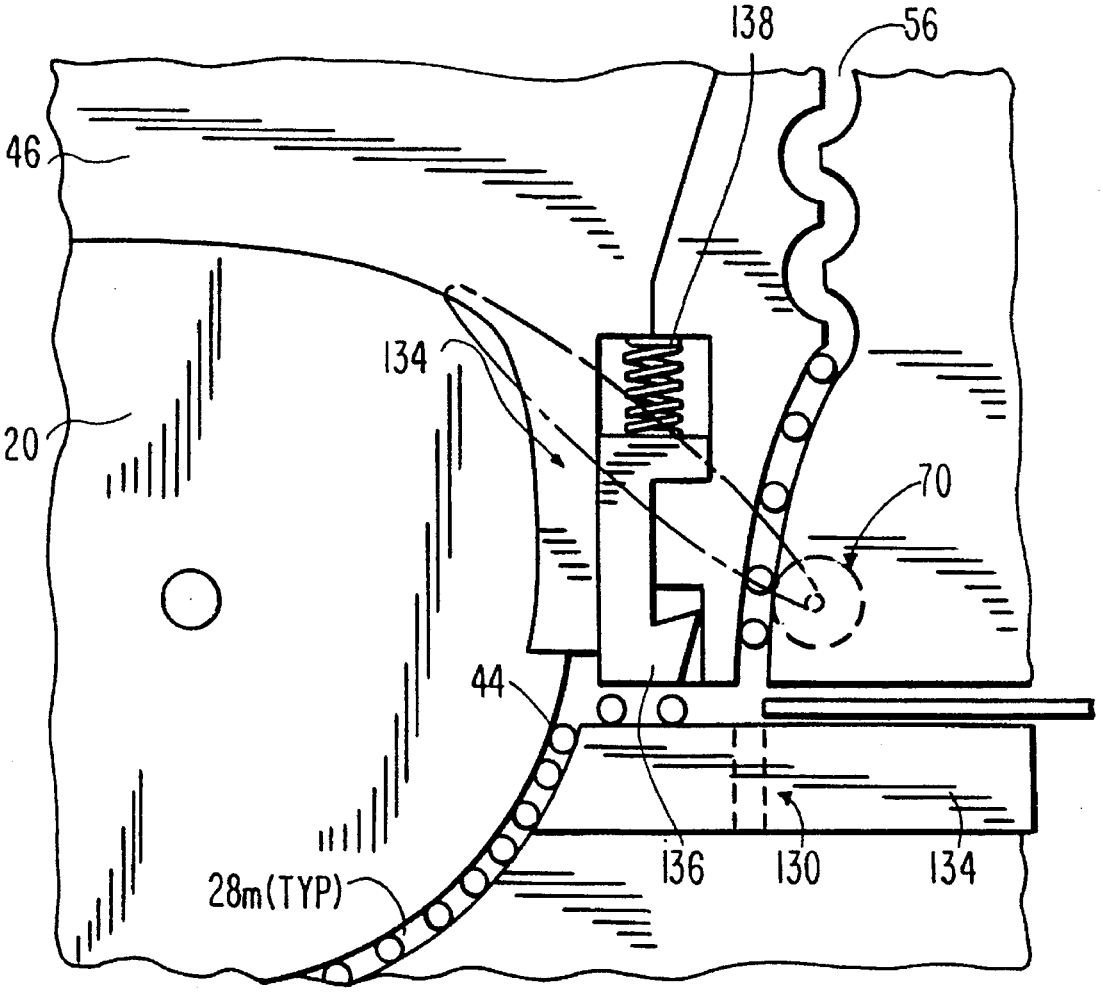
FIG. 21 is an enlarged partial view of the pusher assembly of FIG. 19.

A micro-needle pusher assembly according to the invention shown in FIGS. 19–21. Pusher assembly 120 is provided on apparatus 10 of FIG. 1 to feed micro-needles **28*m* to feed point 44. Pusher assembly 120 is attached to frame 12 in close adjacent relation to feed well 46 and includes air cylinder 122 configured and arranged to receive pressurized air from a source (not shown) via air hoses 124. Air cylinder 122 is attached to linking element 126, linking element 126 configured to be reciprocally moved horizontally toward and away from air cylinder 122. Pusher arm 128 is attached to linking element 126 for the purpose of being reciprocally moved horizontally towards and away from feed point 44. Vacuum source 130 is disposed within vented plate 132 to assist gravity in drawing micro-needle stock 28*m* out of channel 56 of feed well 46. Vented plate 132 defines a plurality of vent holes for permitting air flow from channel 56 therethrough to vacuum source 130. Referring to FIG. 20, stripper assembly 134 is disposed on frame 12 adjacent feed well 46 for the purpose of gating the access of micro-needle stock 28*m* to feed point 44. Stripper assembly 134 includes block member 136 attached to spring 138, spring 138 biasing block member 136 towards vented plate 130 thereby gating access to feed point 44**.

Referring once again to FIGS. 19–21, in operation micro-needle stock **28*m* is drawn out of channel 56 of feed well 46 by a combination of gravity, agitating forces from agitator 70, and suction provided by vacuum source 130. As micro-needle stock 28*m* is drawn out of channel 56 it is positioned on an upper surface of vented plate 132. Pusher arm 128 is horizontally moved towards feed point 44 and into contact with micro-needle stock 28*m*. Pusher arm 128 continues to move towards feed point 44 pushing micro-needle stock 28*m* there along as well. Micro-needle stock 28 is then directed by pusher arm 128 into contact with block member 136 of stripper assembly 134. The contact between micro-needle stock 28***m* and block member 136 causes block member 136 to move vertically towards spring 138 compressing spring 138 a sufficient amount, thereby allowing micro-needle stock 28*m*, with pusher arm 128 therebehind, to pass by block member 136. Pusher arm 128 is further directed by pusher assembly 120 to feed point 44 wherein micro-needle stock 28*m* is contacted with transport wheel 20. Pusher arm 128 is then redirected away from feed point 44, past block member 136, to a position on the distal side of channel 56.

Figure 5:
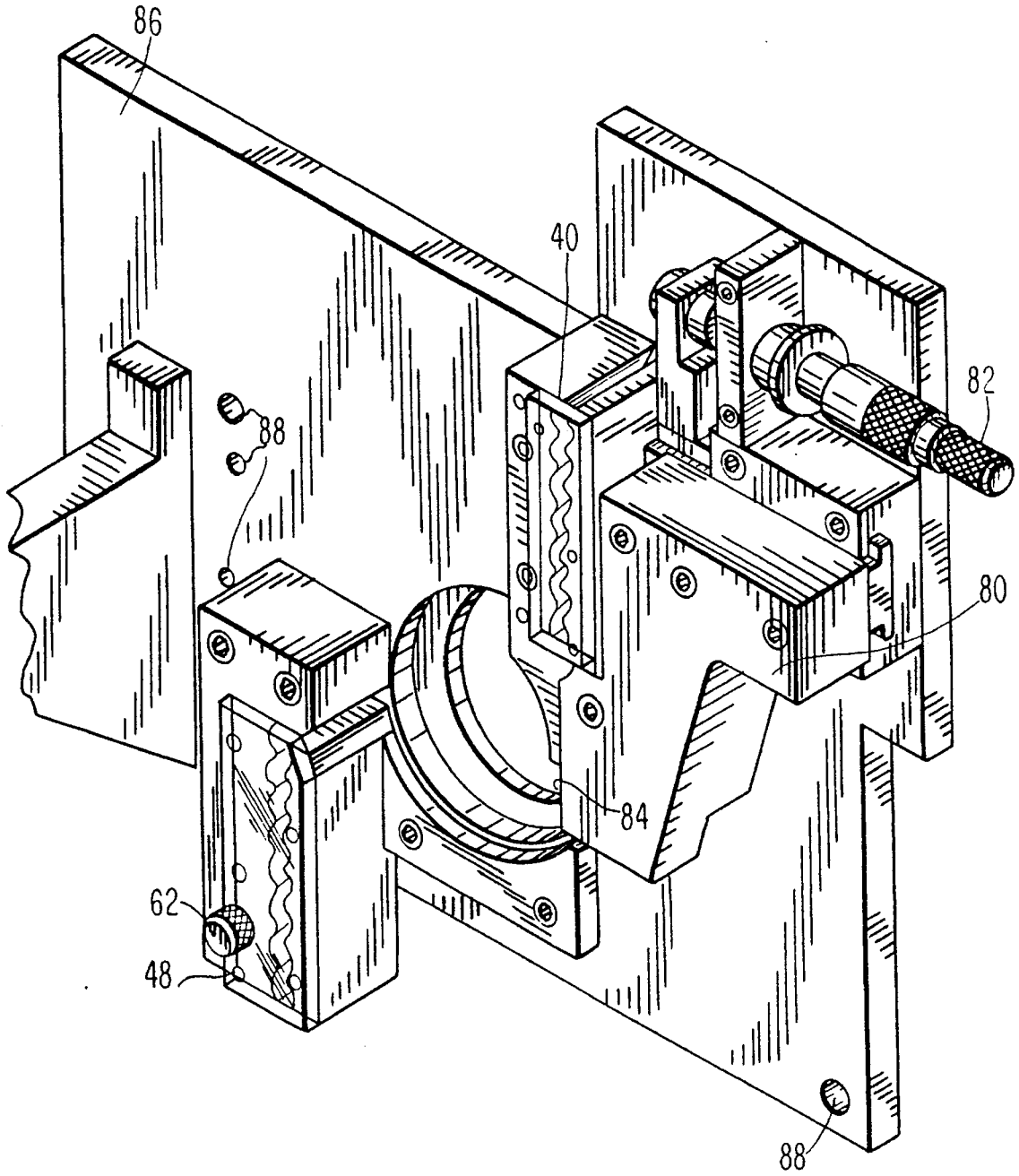
FIG. 5 is partial view of the grinding machine of the present invention illustrating the right side plate, and the feed and off-load wells.

Referring again to FIG. 1, left side plate 72 is mounted on frame 12. Adjustment devices, for example, adjustment micrometers 74 and 76 are provided for adjusting leftside plate horizontally and vertically respectively. Fender 78 is attached to left side plate 72 as shown, and is positioned by adjustment micrometers 74 and 76 to control access to feed point 44 for different sized needle stock workpieces. Similarly, right side plate 80 is mounted to frame 12 as illustrated in FIG. 5. Once again, an adjustment device in the form of adjustment micrometer 82 is provided for adjusting the horizontal position of right side plate 80. Right side plate 80 has a surface 84 positioned opposite that, and facing, fender 70. By varying the position of right side plate 76 and thus surface 80, access to feed point 38 can be adjusted for work pieces of differing sizes.

In the preferred embodiment of the present invention as shown in FIG. 5, frame portion 86 includes off load well 48, feed well 40, adjustment micrometer 82, and right side plate 80 mounted thereon. Frame portion 86 is mounted to frame 12 by bolts (not shown) in apertures 88 to facilitate detaching frame portion 86 from frame 12. Accordingly, frame portion 86 can be quickly detached from frame 12 to permit change-over and attachment of another frame portion previously adjusted off line to accommodate different sized work pieces.

Referring now once again to FIG. 1, grinding wheel adjustment device, for example, mandrel 16, is provided for adjusting the position of the rotational axis of grinding wheel 14 relative to transport wheel 20. Mandrel 16, and thus grinding wheel 14, can be moved longitudinally (i.e., in the direction of the rotational axis) so as to vary the relationship between the grinding wheel and the transport wheel and thus provide various grinding capability.

Figure 18:
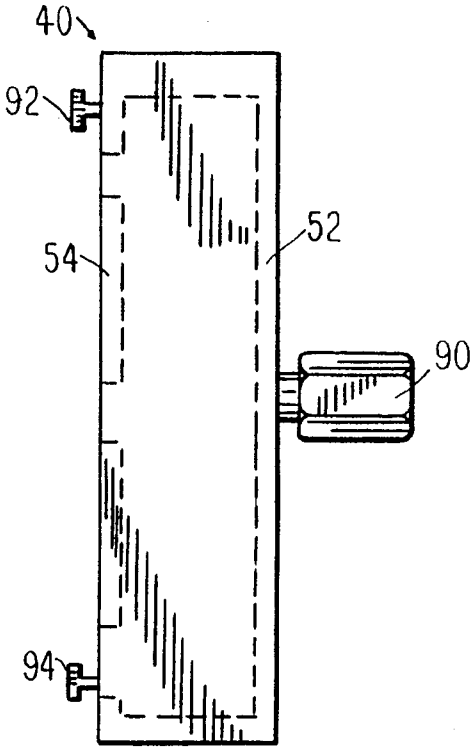
FIG. 18 is a rear view of the cascade-type cartridge of FIG. 16.
Figure 17:
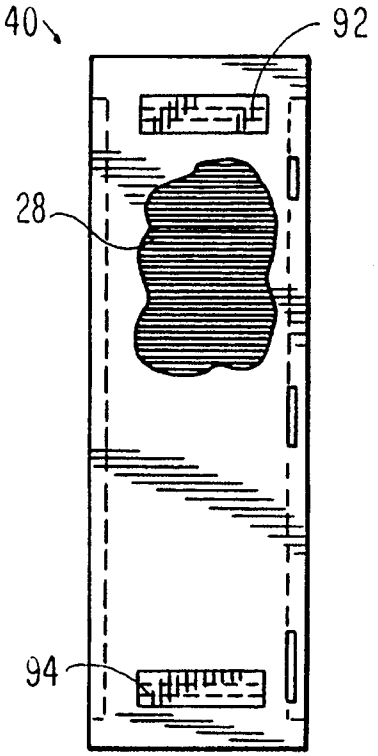
FIG. 17 is partial side cut-away view of the cascade-type cartridge of FIG. 16.
Figure 16:
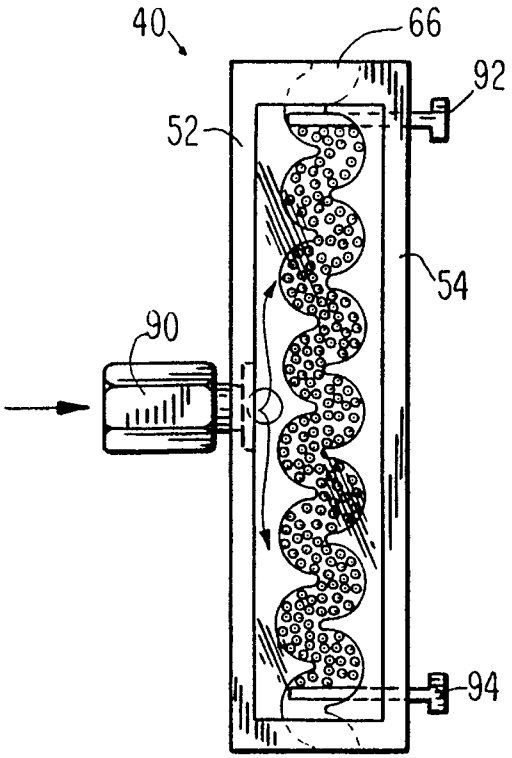
FIG. 16 is a frontal view of a cascade-type cartridge according to a preferred embodiment of the present invention.

FIGS. 16–18 illustrate various alternative embodiments of the feed and off-load cartridges 40 and 42 wherein a fluid inlet 90 is provided for entry of a fluid medium, such as liquid or gas, to clean or otherwise treat the needle stock 28. Fluid inlet 90 communicates with left half section 52 to permit the introduction of fluid into a space (not shown) in the cartridge between front plate 58 and channel 66. Where cleaning is desired, needle stock 28 are positioned within the respective cascade cartridge 40, 42 with needle points facing toward the front plate 58 and are washed as they pass through the cartridge. Upper seal member 92 and lower seal member 94 provide sealing means for selectively containing and draining fluid into and out of the respective cascade cartridge 40, 42. It is also envisioned that cascade cartridge 40, 42 could be provided with an air inlet for selective exposure of forced air over the needle stock workpieces contained therewithin.

Referring to the preferred embodiments of grinding wheel 14 illustrated in FIGS. 12–15, the geometry of the grinding wheel is unique in that it has a generally frusto-conical shape with a concave outer grinding surface. The grinding wheel 14 includes a first end 96 for attachment to mandrel 16, and a second end 98 as shown. The diameter of the grinding wheel 14 is smallest at the second end 98, and increases progressively toward the first end 96 as the curvature of the grinding wheel surface increases. This generally frusto-conical shape is best illustrated in FIG. 15 where grinding surface 100 of grinding wheel 14 is shown having unequal diameters $D_1$ and $D_2$ at respectively different locations.

As described, corresponding diameters of each grinding wheel at any given location differs from the remaining diameters of the wheel. For example, diameter $D_1$, as shown in FIG. 15, is greater than diameter $D_2$ since $D_1$ is measured at a location on grinding wheel 14 which is spaced from second end 98 greater than the distance between diameter $D_2$ and the first end 96. Thus, the grinding wheel which form part of the present invention are generally frusto-conical "bell" shaped as defined by a smaller diameter at one end and a larger diameter at the other end, coupled with the outer concave grinding super. Such wheel configuration contrasts significantly from the prior art wheel 107 shown in FIG. 12*a* which includes opposite ends 104 and 106 of equal diameters with the smallest diameter located midway therebetween. As can be seen from FIG. 12*a*, the outline of prior art wheel 107 is similar in cross-section to a full hyperbolic curve.

Figure 15A:
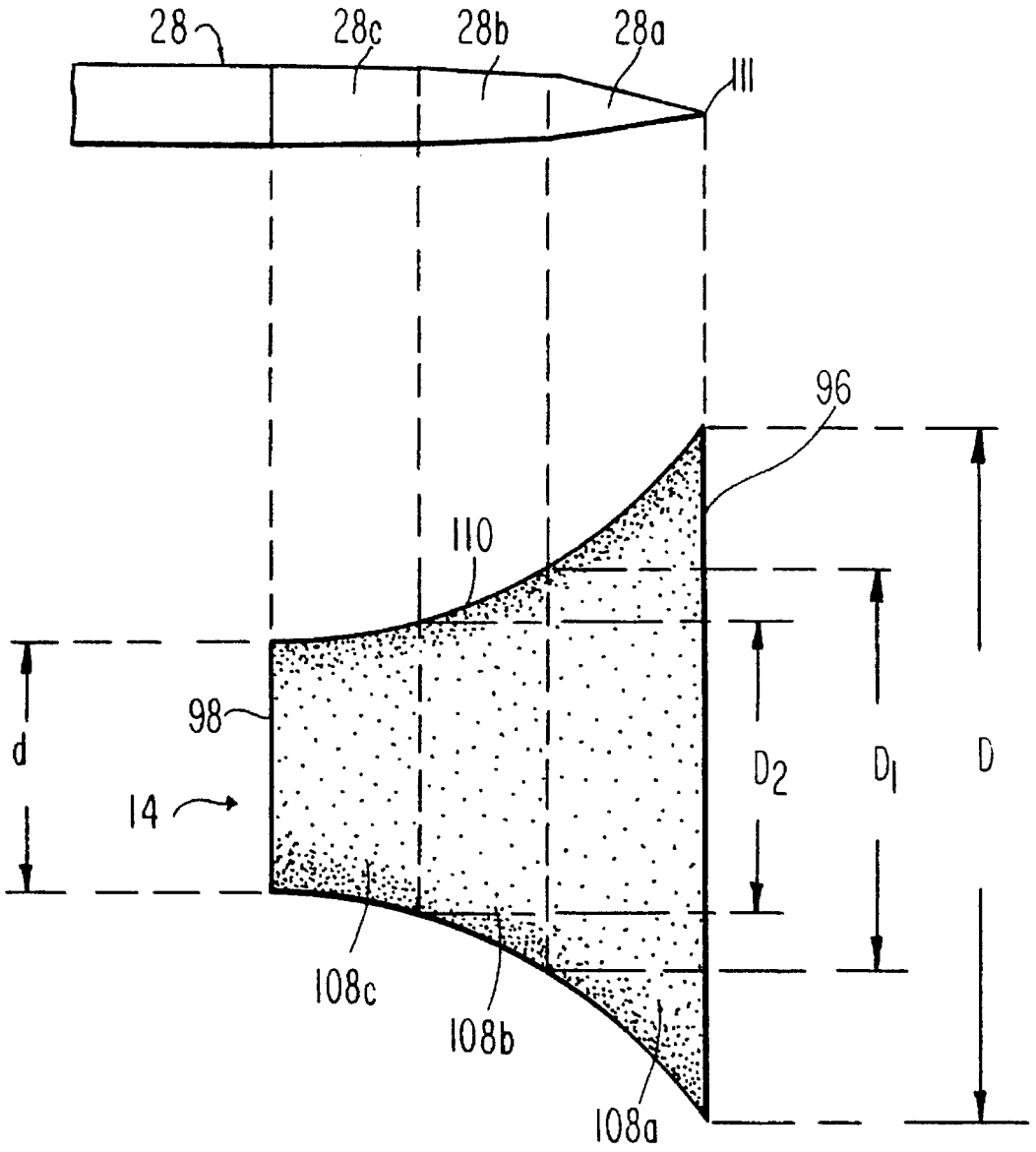
FIG. 15*a* is a frontal view of a grinding wheel and needle stock of a preferred embodiment of the present invention.

Referring now to FIG. 15*a*, grinding wheel 14 is divided into approximately one third sections for purposes of the description. The grinding wheel 14 has a first one third portion 108*a* adjacent major diameter end 96, a third one third portion 108*c* adjacent minor diameter end 98, and a second one third portion 108*b* disposed between the first one third portion 108*a* and the third one third portion 108*c*. Major diameter "D" is located at first end 96 as shown, and represents the largest diameter of grinding wheel 14. Minor diameter d is located on grinding wheel 14 at second end 98 and represents the smallest diameter of grinding wheel 14. Concave surface curve 110 is representative of the contour of grinding wheel 14 and extends from major diameter "D" to minor diameter "d" as shown.

Referring again to FIG. 15*a*, representative needle stock 28 is also shown divided into approximately one third sections with a first one third section 28*a* adjacent needle tip 111, a second one third section 28*b* adjacent to first one third section 28*a*, and a third one third section 28*c* adjacent needle second one third section 28*b*. As shown graphically in FIG. 15*a*, respective needle stock one third section 28*a*, 28*b* and 28*c* are formed substantially by, and correspond generally to the respective grinding wheel one third portions 108*a*, 108*b* and 108*c*. Grinding wheel surface curve 110 has its greatest mean slope along the first one third section 108*a* for forming the maximum mean taper of needle stock 28 on first one third section 28*a*. Surface curve 110 has an intermediate mean slope, less than the mean slope of first one third section 108*a*, along second one third wheel section 108*b*. Finally, wheel second one third section 108*b* forms an intermediate mean taper on needle second one third section 28*b*. The mean taper of needle second one third section 28*b* is less than that of needle first one third section 28*a*. Lastly, the mean slope of surface curve 110 is smallest along third one third section 108*c* of wheel 14 for forming the minimum mean taper of needle third one third section 28*c* of needle stock 28. Accordingly, the mean taper of needle third one third section 28*c* is less than that of needle second one third section 28*b*.

Referring once again to FIG. 15 and 15*a*, in a preferred embodiment wherein tranport wheel 20 has an exemplary diameter of four inches, grinding wheel 14 is used to grind needle stock 28. In order to the obtain desired taper and point grinding on needle stock 20 being directed by the four inch diameter transport wheel 20, grinding wheel 14 will have a diameter of between about 2.90 and about 3.1 inches at first end 96, a diameter of between about 0.80 and about 1.00 inches at second end 98, a diameter $D_1$ of between about 1.5 and about 1.7 inches, and a diameter of $D_2$ of between about 0.95 and about 1.15 inches.

Figure 15D:
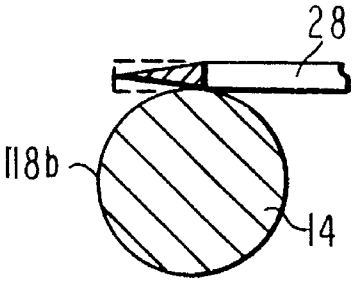
FIG. 15*d* is a cross-sectional view of the grinding wheel of FIG. 15*b* with needle stock in position taken along lines 15*d*–15*d;*
Figure 15C:
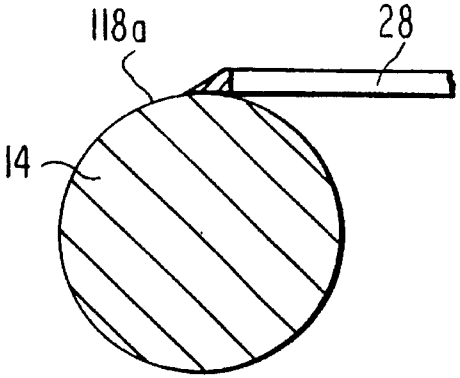
FIG. 15*c* is a cross-sectional view of the grinding wheel of FIG. 15*b* with needle stock in position taken along lines 15*c*–15*c;*
Figure 15E:
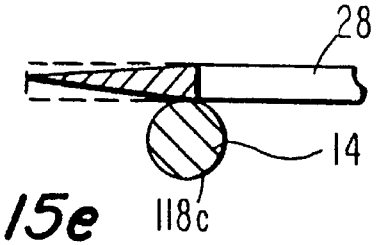
FIG. 15*e* is a cross-sectional view of the grinding wheel of FIG. 15*b* with needle stock in position taken along line 15*e*–15*e;*
Figure 15B:
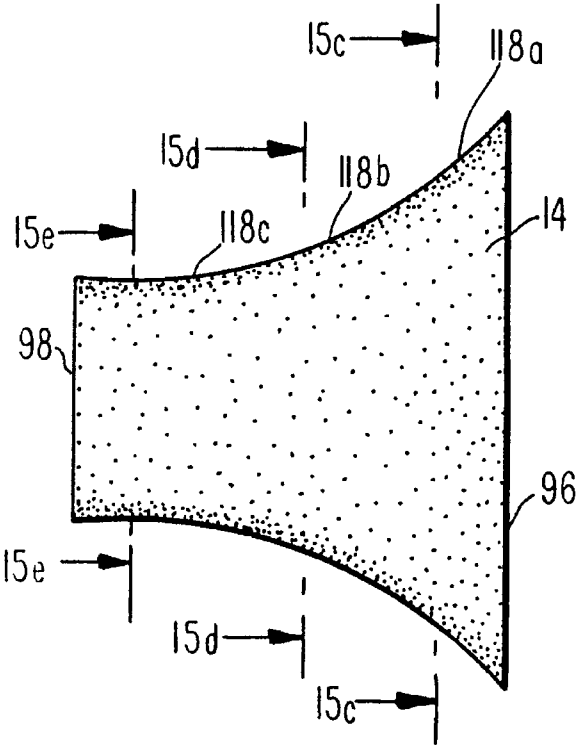
FIG. 15*b* is a frontal view illustrating the grinding wheel of FIG. 15*a;*

Referring to FIGS. 15*b–e* in which needle stock 28 is shown schematically at positions of progressively lesser diameter along the surface of grinding wheel 14, needle stock 28 is shown initially being ground by large diameter portion 118*a* of grinding wheel 14 for removing the largest amount of material from needle stock 28. Referring to FIG. 15*d*, needle stock 28 is shown at intermediate diameter portion 118*b* of grinding wheel 14 which removes an intermediate amount of material from needle stock 28. Finally, FIG. 15*e* illustrates needle stock 28 at a small diameter portion 118*c* on grinding wheel 14 which removes a small amount of material from needle stock 28.

OPERATION

Figure 7:
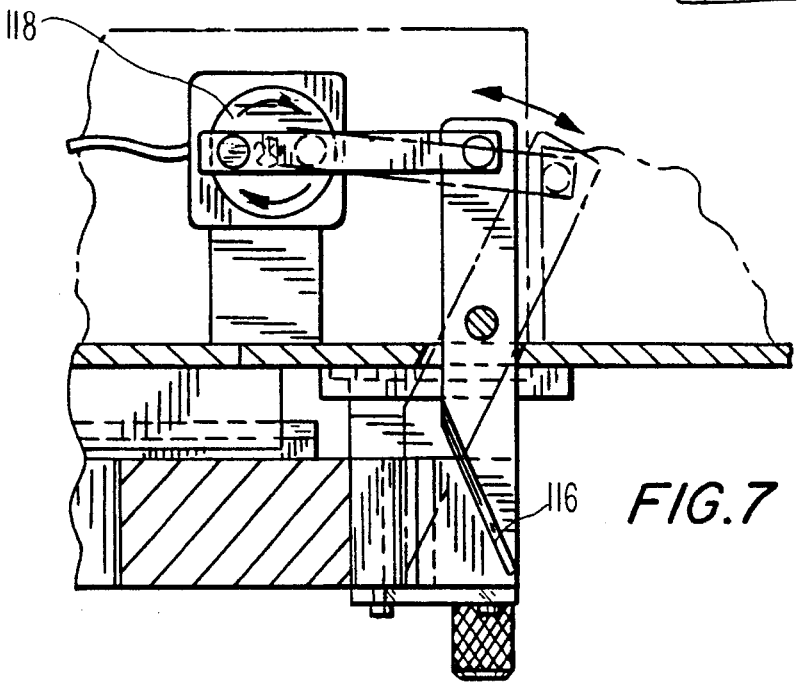
FIG. 7 is a partial top view of the shutter arm of the grinding machine of the present invention.

Referring once again to FIGS. 1–4, 6–11 and 16–18, the operation of grinding apparatus 10 will now be described according to a preferred embodiment of the present invention. Cascade feed cartridge 40, supplied with needle stock 28 off-line, is attached to frame 12 by means of mounting plate 112 which slides into a slot, not shown, in frame 12. Mounting plate 112 facilitates attachment, detachment and replacement of cascade cartridge 40. Stop knob 62 is then manipulated (i.e., pulled out as shown by arrows "B" in FIG. 3) to place associated stop pins 64 in an open or needle stock pass position. Alternatively, knob 62 and associated pin 64 may be made to be removed, rotated or otherwise equivalently manipulated to permit passage of needle stock through the channel 56. Needle stock 28 is channeled through feed well 46 and into contact with shutter arm 116, shown in an open position in FIG. 8, and in a closed position in FIGS. 7 and 9. Shutter arm 116 is moved by shutter motor 118 into an open position thus allowing spaced needle stock 28 to fall from feed well 46 so as to gather at feed point 44.

Grinding wheel 14 is rotated counterclockwise by drive motor 18 via mandrel 16. The preferred operating speed of the grinding wheel 14 and transport wheel 20 depends upon the diameter of the needle stock 28, the diameter of the wheel 14, the types of needle stock and the grinding wheel materials selected. In addition, the surface finish requirements of the finished needle stock will also influence wheel speed.

As can be seen in FIG. 1, the rotational axis of transport wheel 20 is generally transverse to the axis of rotation of grinding wheel 14. Further, transport wheel 20 rotates in a clockwise direction as indicated by arrow A in FIG. 1. In addition, the rotational speed of transport wheel 20, is significantly less than the rotational speed of grinding wheel 14.

Referring again to FIGS. 10–11, needle stock 28 are fed between transport wheel 20 and saddle 26 at feed point 44, and frictionally contacted by rubber layers 38 and 36 of transport wheel 20 and saddle 26, respectively. A contact force is applied to the needle stock 28 by application of downward pressure provided by transport wheel 20. This downward force causes the first one third section 28*a* of the needle stock 28 to contact grinding wheel 14 as shown in FIG. 10. Referring once again to FIGS. 10–11, as needle stock 28 are advanced along the surface of grinding wheel 14, the rotation of transport 20 and frictional contact with rubber layers 36 and 38 causes the needle stock to rotate in the direction of arrow "C" so that the ends of needle stock 28 are evenly exposed to the grinding action of grinding wheel 14.

Referring now to FIGS. 10–15, as needle stock 28 are moved along the surface of grinding wheel 14, a progressively increasing portion of the length of each needle stock makes contact with the grinding wheel 14 so that the desired combination of tapers is formed on the needle stock workpiece when the needle stock reaches the minor end 98 of grinding wheel 14. Other adjustments notwith-standing, this progressively increasing exposure of a longitudinal portion of the needle stock to the grinding surface to provide predetermined combinations of selected tapers is caused by the unique configuration and geometry of grinding wheel 14 as set forth above. This gradually increasing exposure of the needle stock to the grinding surface facilitates formation of the unique tapered point orientation, i.e., more material being removed from the extreme end portion of the stock while proportionately less material is removed from the length of the needle stock shaft proximal of the end portion. The unique configuration of grinding wheel 14 allows this incremental grinding to take place while the grinding wheel remains transverse to transport wheel 20 as shown. Appropriate adjustments can be made, as noted in the description herein above, to adjust the horizontal and vertical axes of the transport and grinding wheel, should it become desirable or necessary to do so, as for example, to skew these axes to provide a particular combination of predetermined tapers.

At the end of one pass across grinding wheel 14, the ground needle stock 28 exit at off-load point 42 and are deposited into off-load well 44. Needle stock 28*g* will then pass through off-load well 48, assuming stop knob 96 is in an open, or "pass" position, and thereafter into off-load cartridge 42. As noted, mounting plate 112 facilitates the detachment of off-load cartridge 42 thereby permitting changeover and attachment of an empty off-load cartridge 42. Certain point configurations may require more than one pass over the grinding surface, or varying adjustments of the relative alignment of the transport and/or grinding wheel depending upon the type of material being ground or the point desired.

Preferably, needle stock 28 is ground by a grinding wheel having a surface of predetermined abrasiveness such that a blunt or flat surface remains on the distal end of the ground needle stock 28*g*. The diameter of the blunt or flat surface between about 20 to about 40 percent the diameter of preground needle stock 28, but preferably about one third, or about 33.33 percent. The grinding machine is then fitted with a grinding wheel configured for polishing which has a surface of predetermined abrasiveness that is less than the abrasiveness of the former grinding wheel, the grinding wheels, however, having nearly identical shapes and surface curves. Ground needle stock 28*g* are then polished by the grinding machine such that a point is formed on the distal end of needle stock 28*g*.

While the invention has been particularly shown and described with reference to the preferred embodiments, it will be understood by those skilled in the art that various modifications in form and detail may be made therein without departing from the scope and spirit of the invention. Accordingly, modifications such as those suggested above, but not limited thereto, are to be considered within the scope of the invention.

What is claimed is:

1. Apparatus for grinding elongated needle workpieces, which comprises:

(a) frame means;

(b) needle workpiece transport means associated with said frame means for transporting a plurality of elongated needle workpieces therealong, said needle workpiece transport means having a predetermined curved transport surface;

(c) needle workpiece feeder means adjacent to said frame means and adapted for feeding needle workpieces to said needle workpiece transport means;

(d) needle workpiece supporting means disposed adjacent said needle workpiece feeder means for supporting the needles workpieces in contact with said needle workpiece transport means; and (e) a grinding wheel disposed adjacent said needle workpiece transport means to engage the needle workpieces while supported by said needle workpiece supporting means, said grinding wheel having a first end of a major diameter and a second end of a minor diameter, said major diameter being greater than said minor diameter, said first and second ends connected by a curved grinding surface the diameter of which increases progressively the radius of curvature of said grinding surface of said grinding wheel in a first one third portion adjacent said first end being of greater mean curvature than the mean curvature of the corresponding opposed portion of said needle workpiece transport means, a second one third portion of said grinding wheel being of greater mean curvature than the mean curvature of the corresponding opposed portion of said needle workpiece transport means, said mean curvature difference being less than the difference between said mean curvature of said first one third portion of said grinding wheel and said first corresponding opposed one third portion of said needle workpiece transport means, and a third one third portion adjacent said second end being of lesser mean curvature than the corresponding opposed portion of said needle workpiece transport means such that a surface portion of a workpiece which progressively contacts said grinding surface between said first and second ends varies relative to the position of the workpiece with respect to said grinding surface.

2. The apparatus according to claim 1 further comprising:

feeder storage means disposed adjacent said needle workpiece feeder means for storing said workpieces and supplying said workpieces to needle workpiece feeder means.

3. The apparatus according to claim 2 further comprising:

needle workpiece reception means disposed adjacent said grinding wheel for reception of workpieces from an off-load point located between said grinding means and said workpiece reception means, such that the workpieces are individually received therein.

4. The apparatus according to claim 2 further comprising:

off-load needle workpiece storage means disposed adjacent said needle workpiece reception means for reception of workpieces therefrom.

5. Apparatus for grinding tapers or points on a plurality of elongated needle workpieces, which comprises;

(a) frame means;

(b) needle workpiece transport means associated with said frame means and adapted for transporting a plurality of elongated needle workpieces therealong, said needle workpiece transport means having a predetermined transport surface;

(c) needle workpiece feeder means adjacent to said frame means for feeding needle workpieces to said needle workpiece transport means;

(d) needle workpiece supporting means disposed adjacent said needle workpiece feeder means for supporting said needle workpieces in contact with said needle workpiece transport means;

(e) grinder means including a grinding surface disposed adjacent said needle workpiece transport means to engage the workpieces supported by said needle workpiece supporting means, said grinding surface configured and dimensioned such that a surface portion of each workpiece which contacts said grinding surface varies relative to the position of the workpiece with respect to said grinding surface;

(f) detachable feeder storage means disposed adjacent said needle workpiece transport means and said needle workpiece supporting means, for storing said workpieces and supplying said workpieces to a feed point on said apparatus located between said needle workpiece transport means and said needle workpiece supporting means such that said workpieces are individually positioned between said needle workpiece transport means and said needle workpiece supporting means;

(g) needle workpiece reception means disposed adjacent said grinding means for reception of workpieces from an off-load point located between said grinding means and said workpiece reception means, such that the workpieces are individually received therein; and (h) detachable off-load workpiece storage means disposed adjacent said needle workpiece reception mean for reception of workpieces from said needle workpiece reception means.

6. The apparatus according to claim 5 wherein said grinding means comprises a grinding wheel disposed adjacent said needle workpiece transport means to engage said needle workpieces while supported by said needle workpiece supporting means, said grinding wheel having a first end of a major diameter and a second end of a minor diameter, said major diameter being greater than said minor diameter, said diameters connected by a curved grinding surface the diameter of which increases progressively, the radius of curvature of said grinding surface of said grinding wheel in a first one third portion adjacent said first end being of greater mean curvature than the mean curvature of the corresponding opposed portion of said needle workpiece transport means, a second one third portion of said grinding wheel being of greater mean curvature than the mean curvature of the corresponding opposed portion of said needle workpiece transport means, said mean curvature difference being less than the difference between said mean curvature of said first one third portion of said grinding wheel and said first corresponding opposed one third portion of said needle workpiece tranport means, and a third one third portion adjacent said second end being of lesser mean curvature than the corresponding opposed portion of said needle workpiece transport means such that a surface portion of a workpiece which progressively contacts said grinding surface between said first and second ends varies relative to the position of the workpiece with respect to said grinding surface.

7. The apparatus according to claim 5 wherein said detachable feeder storage means comprises a cartridge having an inlet means for reception of said workpieces, storage means for storing said workpieces and outlet means for discharging said workpieces to said needle workpiece feeder means in a cascading fashion.

8. The apparatus according to claim 5 wherein said off-load workpiece storage means comprises a cartridge having inlet means for individual reception of said workpieces from said workpiece reception means and storage means for reception of said workpieces in a cascading fashion wherein the workpieces are stored.

9. Apparatus for grinding tapers or points on a plurality of elongated needle workpieces, which comprises;

(a) frame means;

(b) needle workpiece transport means associated with said frame means and adapted for transporting a plurality of elongated needle workpieces therealong, said needle workpiece transport means having a predetermined transport surface;

(c) needle workpiece feeder means adjacent to said frame means for feeding needle workpieces to said needle workpiece transport means;

(d) needle workpiece supporting means disposed adjacent said needle workpiece feeder means for supporting said needle workpieces in contact with said needle workpiece transport means;

(e) grinder means including a grinding surface disposed adjacent said needle workpiece transport means to engage the workpieces supported by said needle workpiece supporting means, said grinding surface configured and dimensioned such that a surface portion of each workpiece which contacts said grinding surface varies relative to the position of the workpiece with respect to said grinding surface;

(f) detachable feeder storage means disposed adjacent said needle workpiece transport means and said needle workpiece supporting means, for storing said workpieces and supplying said workpieces to a feed point on said apparatus located between said needle workpiece transport means and said needle workpiece supporting means such that said workpieces are individually positioned between said needle workpiece transport means and said needle workpiece supporting means;

(g) needle workpiece reception means disposed adjacent said grinding means for reception of workpieces from an off-load point located between said grinding means and said workpiece reception means, such that the workpieces are individually received therein;

(h) detachable off-load workpiece storage means disposed adjacent said needle workpiece reception mean for reception of workpieces from said needle workpiece reception means; and (i) means for adjusting the position of said grinding means relative to said needle workpiece supporting means and said transport means.

10. Apparatus for grinding tapers or points on a plurality of elongated needle workpieces, which comprises;

(a) frame means;

(b) needle workpiece transport means associated with said frame means and adapted for transporting a plurality of elongated needle workpieces therealong, said needle workpiece transport means having a predetermined transport surface;

(c) needle workpiece feeder means adjacent to said frame means for feeding needle workpieces to said needle workpiece transport means;

(d) needle workpiece supporting means disposed adjacent said needle workpiece feeder means for supporting said needle workpieces in contact with said needle workpiece transport means;

(e) grinder means including a grinding surface disposed adjacent said needle workpiece transport means to engage the workpieces supported by said needle workpiece supporting means, said grinding surface configured and dimensioned such that a surface portion of each workpiece which contacts said grinding surface varies relative to the position of the workpiece with respect to said grinding surface;

(f) detachable feeder storage means disposed adjacent said needle workpiece transport means and said needle workpiece supporting means, for storing said workpieces and supplying said workpieces to a feed point on said apparatus located between said needle workpiece transport means and said needle workpiece supporting means such that said workpieces are individually positioned between said needle workpiece transport means and said needle workpiece supporting means;

(g) needle workpiece reception means disposed adjacent said grinding means for reception of workpieces from an off-load point located between said grinding means and said workpiece reception means, such that the workpieces are individually received therein; and (h) detachable off-load workpiece storage means disposed adjacent said needle workpiece reception mean for reception of workpieces from said needle workpiece reception means, wherein said needle workpiece feeder means includes adjusting means having at least one adjustment micrometer operatively connected to said needle workpiece feeder means.

11. Apparatus for grinding tapers or points on a plurality of elongated needle workpieces, which comprises;

(a) frame means;

(b) needle workpiece transport means associated with said frame means and adapted for transporting a plurality of elongated needle workpieces therealong, said needle workpiece transport means having a predetermined transport surface;

(c) needle workpiece feeder means adjacent to said frame means for feeding needle workpieces to said needle workpiece transport means;

(d) needle workpiece supporting means disposed adjacent said needle workpiece feeder means for supporting said needle workpieces in contact with said needle workpiece transport means;

(e) grinder means including a grinding surface disposed adjacent said needle workpiece transport means to engage the workpieces supported by said needle workpiece supporting means, said grinding surface configured and dimensioned such that a surface portion of each workpiece which contacts said grinding surface varies relative to the position of the workpiece with respect to said grinding surface;

(f) detachable feeder storage means disposed adjacent said needle workpiece transport means and said needle workpiece supporting means, for storing said workpieces and supplying said workpieces to a feed point on said apparatus located between said needle workpiece transport means and said needle workpiece supporting means such that said workpieces are individually positioned between said needle workpiece transport means and said needle workpiece supporting means;

(g) needle workpiece reception means disposed adjacent said grinding means for reception of workpieces from an off-load point located between said grinding means and said workpiece reception means, such that the workpieces are individually received therein; and (h) detachable off-load workpiece storage means disposed adjacent said needle workpiece reception mean for reception of workpieces from said needle workpiece reception means, wherein said needle workpiece feeder means comprises a feed well, said workpiece feeder means further comprising left side adjustment means, and right side adjustment means, said feed well having an inlet for reception of workpiece from said feeder storage means, and a channel portion disposed between said inlet and said feed point configured to allow said workpieces from said inlet to pass therethrough to said feed point, said left side adjustment means and said right side adjustment means configured to vary the size and position of said feed point.

12. Apparatus for grinding tapers or points on a plurality of elongated needle workpieces, which comprises;

(a) frame means;

(b) needle workpiece transport means associated with said frame means and adapted for transporting a plurality of elongated needle workpieces therealong, said needle workpiece transport means having a predetermined transport surface;

(c) needle workpiece feeder means adjacent to said frame means for feeding needle workpieces to said needle workpiece transport means;

(d) needle workpiece supporting means disposed adjacent said needle workpiece feeder means for supporting said needle workpieces in contact with said needle workpiece transport means;

(e) grinder means including a grinding surface disposed adjacent said needle workpiece transport means to engage the workpieces supported by said needle workpiece supporting means, said grinding surface configured and dimensioned such that a surface portion of each workpiece which contacts said grinding surface varies relative to the position of the workpiece with respect to said grinding surface;

(f) detachable feeder storage means disposed adjacent said needle workpiece transport means and said needle workpiece supporting means, for storing said workpieces and supplying said workpieces to a feed point on said apparatus located between said needle workpiece transport means and said needle workpiece supporting means such that said workpieces are individually positioned between said needle workpiece transport means and said needle workpiece supporting means;

(g) needle workpiece reception means disposed adjacent said grinding means for reception of workpieces from an off-load point located between said grinding means and said workpiece reception means, such that the workpieces are individually received therein; and (h) detachable off-load workpiece storage means disposed adjacent said needle workpiece reception mean for reception of workpieces from said needle workpiece reception means, wherein said needle workpiece reception means has an off-load well, said off-load well having an inlet for reception of workpieces from said off-load point, an outlet, and a channel portion disposed between said inlet and said outlet configured to allow said workpieces from said inlet to pass therethrough and exit via said outlet to said detachable off-load storage means.

13. The apparatus according to claim 12 wherein said grinding means includes a wheel comprised of material selected from the group consisting of steel and aluminum.

14. The apparatus according to claim 12 wherein at least a portion of said grinding surface of said grinding means is formed of an abrasive grinding material.

15. The apparatus according to claim 14 wherein said abrasive grinding material is selected from the group consisting of cubic boron nitrite, diamond, silicon carbide and aluminum oxide.

16. The apparatus according to claim 12 wherein said abrasive grinding material is electroplated.

17. The apparatus according to claim 6 wherein said detachable feeder storage means comprises a hopper, said hopper having an inlet for reception of said workpieces, and a channel portion disposed between said inlet and said feed point configured to allow said workpieces from said inlet to pass therethrough to said feed point.

18. The apparatus according to claim 17 wherein said channel portion has a diameter greater than, but less than twice that of said workpieces to pass therethrough, said channel portion forming a generally sinusoidal shape having a plurality of radii of curvature.

19. Apparatus for grinding elongated needle workpieces, which comprises:

(a) frame means;

(b) needle workpiece transport means associated with said frame means for transporting a plurality of elongated needle workpieces therealong, said needle workpiece transport means having a predetermined generally convex curved transport surface;

(c) needle workpiece feeder means adjacent to said frame means and adapted for feeding needle workpieces to said needle workpiece transport means;

(d) needle workpiece supporting means disposed adjacent said needle workpiece feeder means for supporting said needles workpieces in contact with said needle workpiece transport means; and (e) a grinding wheel disposed adjacent said needle workpiece transport means to engage said needle workpieces while supported by said needle workpiece supporting means, said grinding wheel having a first end of a major diameter and a second end of a minor diameter, said major diameter end being greater than said minor diameter end and connected thereto by a generally concave curved grinding surface the diameter of which increases progressively, the radius of curvature of said grinding surface of said grinding wheel in a first one third portion adjacent said major diameter end being of greater mean curvature than the mean curvature of the corresponding opposed portion of said needle workpiece transport means, a second one third portion of said grinding wheel being of greater mean curvature than the mean curvature of the corresponding opposed portion of said needle workpiece transport means, said mean curvature difference being less than the difference between said mean curvature of said first one third portion of said grinding wheel and said first corresponding opposed one third portion of said workpiece transport means, and a third one third portion adjacent said minor diameter and being of lesser mean curvature than the corresponding opposed portion of said needle workpiece transport means, said mean curvature difference of said third one third portion being less than the mean curvature difference of said second one third portion, the difference between said mean curvature difference between said second and third one third portions being less than the difference between said mean curvature difference between said first and second one third portions.

* * * * *